United States Patent [19]

Frisbee

[11] Patent Number: 4,854,392

[45] Date of Patent: Aug. 8, 1989

[54] HOSE POSITIONING ASSEMBLY

[75] Inventor: Claude M. Frisbee, Schofield, Wis.

[73] Assignee: J. I. Case Company, Racine, Wis.

[21] Appl. No.: 174,256

[22] Filed: Mar. 28, 1988

[51] Int. Cl.[4] ..... B05B 15/06

[52] U.S. Cl. ..... 172/813; 280/421; 248/60

[58] Field of Search ..... 172/813; 248/51, 52, 248/74.1, 60, 68.1; 280/421

[56] References Cited

U.S. PATENT DOCUMENTS

| | | | |
|---|---|---|---|
| 2,129,320 | 9/1938 | Geairns | 248/60 X |
| 3,208,769 | 9/1965 | Onori | 280/421 |
| 3,420,546 | 1/1969 | Jasovsky | 248/51 |
| 3,650,545 | 3/1972 | Freed | 280/421 |
| 4,111,268 | 9/1978 | Frisbee | 172/813 |
| 4,572,302 | 2/1986 | Frisbee | 172/813 |

*Primary Examiner*—Richard J. Johnson

*Attorney, Agent, or Firm*—Ralph T. Rader

[57] ABSTRACT

A hose positioning and tensioning assembly for a vehicle having a transverse scraper blade supported on the forward end of the vehicle for relative movement. A plurality of hydraulic fluid lines extend from the lower forward end of the vehicle to the rear of the blade in an arch. The hose positioning and tensioning assembly holds the fluid line arch in an upright position and maintains a tension on the arch during any movement of the blade relative to the vehicle. Further, the hose positioning and tensioning assembly permits the blade to be moved without interfering with or twisting the hydraulic fluid lines.

1 Claim, 1 Drawing Sheet

HOSE POSITIONING ASSEMBLY

BACKGROUND OF THE INVENTION

The present invention relates to bulldozers, tractors and the like having transversely extending scraper blades, and more particularly, to a hose positioning and tensioning assembly for maintaining a constant tension on the hydraulic hose arch to keep it in an upright position.

Modern bulldozer blades may be hydraulically angled, tilted, pitched, raised and lowered to adjust the blade in any desired position. The blade is conventionally supported on a U- or C-shaped frame which is pivotally connected adjacent its ends to the sides of the bulldozer. The blade is typically supported adjacent its mid-portion to the center of the frame and the opposed sides are connected to hydraulic cylinders for angling, pitching, or tilting the blade. The blade may be supported on a ball joint with the control including all three functions, such as shown in my prior U.S. Pat. No. 3,645,340.

Since the blade may be angled, tilted, pitched, raised and lowered, the hydraulic control for the blade includes a plurality of flexible hydraulic lines which extend from the front of the dozer to the back of the scraper blade and then in opposite along the back of the blade to the adjacent side edges of the blade. These hydraulic control lines may become tnagled or damaged during adjustment of the blade unless there is some means for protecting them against accidental damage during movement of the blade. An apparatus for protecting the flexible hydraulic lines is set forth in my prior U.S. Pat. No. 4,111,268, which includes a channel-shaped shroud or guard extending across the blade from side-to-side having connections for distributing the hydraulic fluid lines to the hydraulic cylinders. Further, a cowl or guide is provided on the top of the bulldozer blade which includes a guide strap for receiving the hydraulic control lines. Moreover, a flexible guard support sheet and clamp assembly is bolted to the forward end of the tractor for enclosing the lines as they extend from the tractor.

While the guard support assembly protects and supports the upwardly extending arch of the control lines, a problem exists in holding the hose arch in an upright position during all movements of the blade. Further, the guide strap on the back of the blade for receiving the hydraulic control lines and the clamps on the guard support assembly are susceptible to loosening or breakage due to the environmental conditions when the blade is moved to its various positions. Thus, there has been a need for a hose positioning and tensioning assembly for the multiple hose arch extending from the front of the tractor to the back of the dozer blade for holding the hose arch in an upright position when the blade is angled, tilted, pitched, raised or lowered. As more fully described hereinbelow, the present invention proves such an assembly.

SUMMARY OF THE INVENTION

The hose positioning and tensioning assembly of the present invention may be utilized in a conventional bulldozer, tractor, or the like having a frame, such as a U-shaped frame, which mounts a blade for angling, tilting, pitching, raising and lowering. The hydraulic control for the dozer includes flexible hydraulic lines which extend from the front of the dozer to the back of the scraper blade and then in opposite directions along the back of the blade to the adjacent side edges of the blade. Further, the hydraulic control lines extend in an arch from the lower forward end of the bulldozer to the back of the bulldozer blade.

According to the present invention, the hose positioning and tensioning assembly includes a clamp, a cable element, a coil type extension spring, and a pulley, which are positioned in a cooperative relationship for the purpose of holding the hydraulic hose arch in an upright position. The cable is connected at one end to the clamp and at its opposite end to the coil type extension spring. The clamp holds the hydraulic hose lines in a group so that the group of hoses may be held in an arch in an upright position. The pulley is rotatably mounted within the engine compartment with the cable extending from the clamp and over the pulley for attachment to the extension spring. The coil type extension spring is connected between the cable and a fixed member within the engine compartment.

As the bulldozer blade is raised and lowered, the extension spring and cable maintain a constant tension on the hydraulic hose line arch thereby keeping it in an upright position while compensating for the changes in the arch of the hoses. The bulldozer blade may be raised and lowered, angled, tilted and pitched without twisting or interfering with the hydraulic control lines. Further, since the hose arch is not connected to the blade or front of the tractor by clamps or brackets, the hose arch may be maintained in an upright position without loosening or breaking such elements. Moreover, the present construction provides more flexibility in the event that debris and the like falls over the blade into the hoses.

Other advantages and meritorious features of the hose positioning and tensioning assembly of the present invention will be more fully understood from the following description of the invention, the appended claims, and the drawings, a brief description of which follows.

DESCRIPTION OF THE INVENTION

Figure 1:
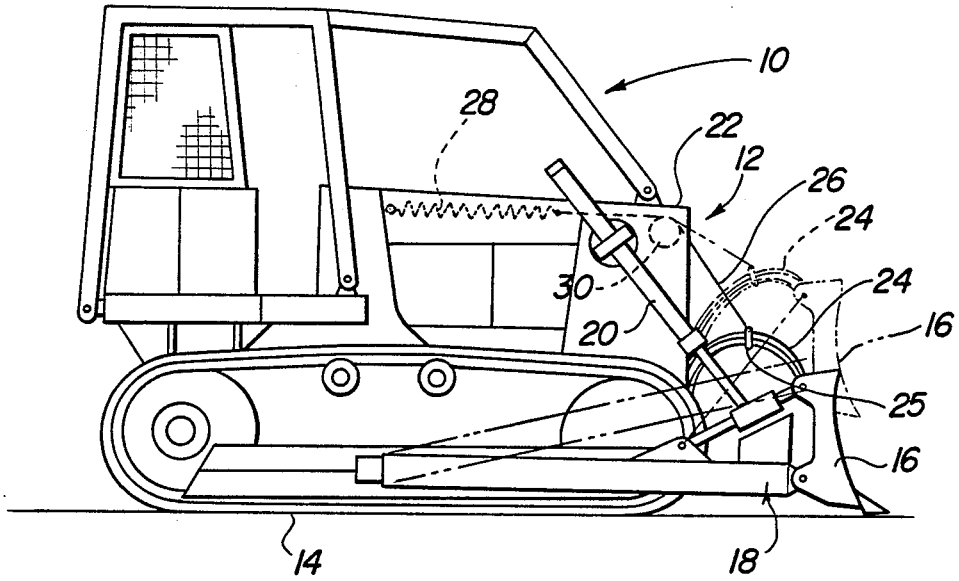
FIG. 1 is a side elevation of a conventional bulldozer having the hose positioning and tensioning assembly of the present invention.
Figure 2:
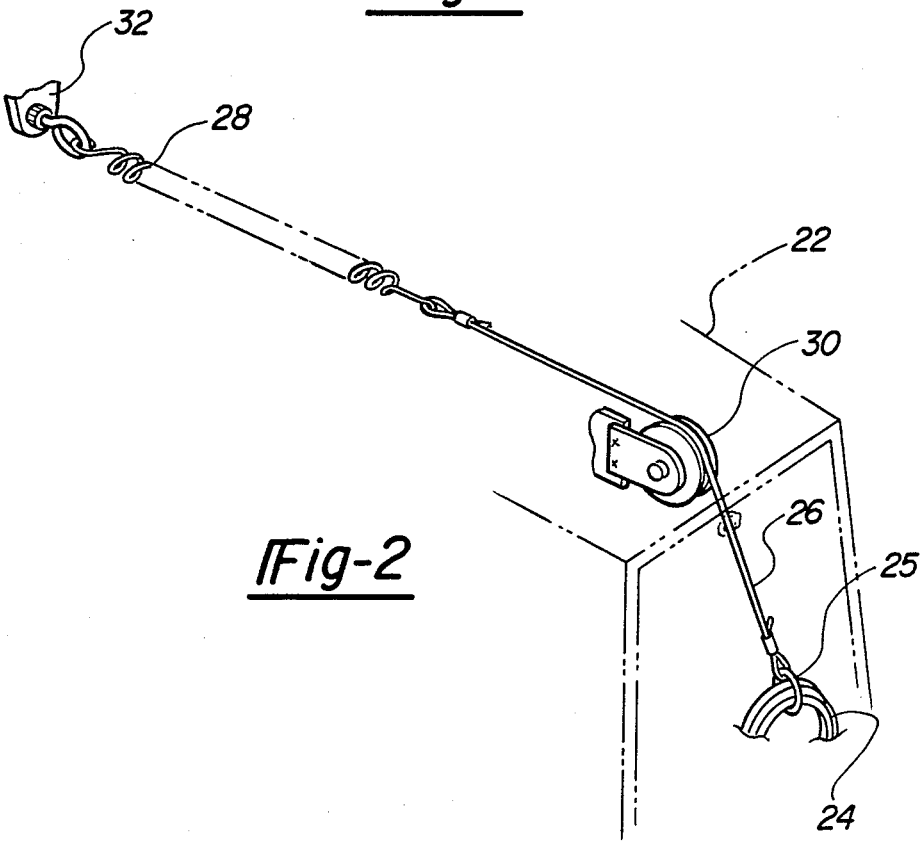
FIG. 2 is a perspective view of the hose positioning and tensioning assembly.

A crawler tractor or bulldozer 10 having the hose positioning and tensioning assembly 12 of the present invention is illustrated in FIG. 1. It will be understood that the hose positioning and tensioning assembly 12 may be utilized in other implements having the prior art problems described hereinabove. The following description, however, will be limited to a bulldozer of the type shown for simplicity of illustration and because the hose positioning and tensioning assembly of the present invention is particularly suitable for a bulldozer of the type shown.

The bulldozer 10 includes tracks 14 on its opposed sides and a conventional transverse scraper blade 16 which is supported on a frame assembly 18. As is conventional, the frame assembly and blade 16 are raised and lowered by lift cylinders 20 which are pivotally mounted on opposite sides of engine compartment 22. Further, blade 16 may be angled, tilted, or pitched. The details of the control mechanism and structure that is necessary for maneuvering the blade are conventional and may be found in my prior U.S. Pat. No. 4,111,368, which is incorporated by reference herein.

As shown in FIG. 1, the hydraulic control lines 24 for the control cylinders extend in an arch from the lower forward end of bulldozer 10 to the back of the bulldozer blade 16. According to the present invention, the hose positioning and tensioning assembly 12 includes a clamp 25, a cable element 26, a coil type extension spring 28, and a pulley 30. The cable 26 is connected at one end to clamp 25 and at its opposite end to coil spring 28. Clamp 25 holds the hoses 24 in a group so that the entire group of hoses may be arched into an upright position as shown. Pulley 30 is mounted for rotatable movement within the engine compartment 22 and cable 26 extends from clamp 25 and over pulley 30 where it is attached to coil spring 28. Coil spring 28 is connected between cable 26 and a fixed support 32 within engine compartment 22.

In operation, the coil type extension spring 28 maintains a constant tension on cable 26 and hose clamp 25 as the blade 16 is raised, lowered, tilted, pitched or angled. This tension maintains the upright position of the hose arch extending from the front of the tractor to the back of the dozer blade and compensates for the changes in the arch of the hoses. Further, because of the flexibility of the present construction, the dozer blade 16 may be raised and lowered or otherwise maneuvered without interfering or twisting the hydraulic control lines 24, which prevents damage to the hydraulic control lines. Moreover, since the clamp, cable and spring assembly permits movement of the hose arch while maintaining it in an upright position, the prior art problem of loosening clamps and breakage is eliminated.

It will be understood by those skilled in the art that a spring powered cable reel (not shown) may be mounted at the location where pulley 30 is illustrated for providing the same constant tension on hose clamp 25 as that provided by extension spring 28. Thus, it will be obvious to those skilled in the art that various modifications can be made to the present construction and components used therein without departing from the spirit and scope of the present invention. Having described the improved hose positioning and tensioning assembly of this invention and its operation.

What is claimed is:

1. A hose positioning and tensioning assembly for a vahicle having an engine compartment and a transverse blade supported on the forward end of said vehicle, said blade being movable relative to said vehicle, a plurality of flexible hydraulic fluid lines extending from a lower forward end of said vehicle in an upwardly extending arch to a rearward portion of said blade in a downwardly extending arch, and said hose positioning and tensioning assembly comprising adjustable and flexible tensioning means for holding said plurality of hydraulic fluid lines in an upright position during movement of the blade relative to the vehicle and maintaining tension on said plurality of hydraulic fluid lines during any movement of said blade or changes in the arch formed by said fluid lines;

said hose positioning and tensioning assembly comprises means for holding said plurality of hydraulic fluid lines in a group, connection means connected between a resilient means and said holding means, and means for rotatably supporting said connection means along its length; and wherein said resilient means and rotatable support means are mounted within said engine compartment and said holding means being connected to said plurality of hydraulic fluid lines at a location between said upwardly extending arch and said downwardly extending arch.

* * * * *